US011841174B2

(12) United States Patent
Larsen et al.

(10) Patent No.: US 11,841,174 B2
(45) Date of Patent: Dec. 12, 2023

(54) METHOD FOR CONTROLLING EJECTOR CAPACITY IN A VAPOUR COMPRESSION SYSTEM

(71) Applicant: Danfoss A/S, Nordborg (DK)

(72) Inventors: Lars Finn Sloth Larsen, Nordborg (DK); Jan Prins, Nordborg (DK); Kenneth Bank Madsen, Nordborg (DK)

(73) Assignee: Danfoss A/S, Nordborg (DK)

( * ) Notice: Subject to any disclaimer, the term of this patent is extended or adjusted under 35 U.S.C. 154(b) by 40 days.

(21) Appl. No.: 17/479,014

(22) Filed: Sep. 20, 2021

(65) Prior Publication Data

US 2022/0003473 A1 Jan. 6, 2022

Related U.S. Application Data

(62) Division of application No. 16/479,360, filed as application No. PCT/EP2017/083858 on Dec. 20, 2017, now Pat. No. 11,162,724.

(30) Foreign Application Priority Data

Feb. 28, 2017 (DK) ..... PA201700135

(51) Int. Cl.

| | |
|---|---|
| ***F25B 1/10*** | (2006.01) |
| ***F25B 5/02*** | (2006.01) |
| ***F25B 49/02*** | (2006.01) |
| ***F25B 41/385*** | (2021.01) |
| ***F25B 41/20*** | (2021.01) |

(52) U.S. Cl.

CPC ..... *F25B 1/10* (2013.01); *F25B 5/02* (2013.01); *F25B 41/20* (2021.01); *F25B 41/385* (2021.01); *F25B 49/02* (2013.01); *F25B 2341/0012* (2013.01); *F25B 2341/0013* (2013.01); *F25B 2341/0015* (2013.01); *F25B 2400/0407* (2013.01)

(58) Field of Classification Search

CPC .... F25B 49/02; F25B 5/02; F25B 2341/0012; F25B 2341/0013; F25B 2341/0015; F25B 2400/0407

USPC ..... 62/116

See application file for complete search history.

(56) References Cited

U.S. PATENT DOCUMENTS

2007/0000262 A1* 1/2007 Ikegami ..... F25B 41/00 62/170

FOREIGN PATENT DOCUMENTS

WO WO-2016180481 A1 * 11/2016 ..... F25B 1/06

* cited by examiner

*Primary Examiner* — Steve S Tanenbaum

(74) *Attorney, Agent, or Firm* — McCormick, Paulding & Huber PLLC

(57) ABSTRACT

A method for controlling ejector capacity in a vapour compression system (1) is disclosed. A parameter value being representative for a flow rate of liquid refrigerant from the evaporator(s) (8, 10) and into a return pipe (12, 13) is obtained, and the capacity of the ejector(s) (6) is adjusted based on the obtained parameter value. Ejector capacity may be shifted between low pressure ejectors (liquid ejectors) (6*a*, 6*b*, 6*c*, 6*d*) and high pressure ejectors (gas ejectors) (6*e*, 6*f*).

15 Claims, 5 Drawing Sheets

METHOD FOR CONTROLLING EJECTOR CAPACITY IN A VAPOUR COMPRESSION SYSTEM

CROSS-REFERENCE TO RELATED APPLICATIONS

This application is a divisional of U.S. patent application Ser. No. 16/479,360 filed on Jul. 19, 2019, which is a National Stage application of International Patent Application No. PCT/EP2017/083858 filed on Dec. 20, 2017, which claims priority to Danish Patent Application No. PA201700135 filed on Feb. 28, 2017, each of which is hereby incorporated by reference in its entirety.

TECHNICAL FIELD

The present invention relates to a method for controlling ejector capacity in a vapour compression system. More particularly, the method of the invention allows required ejector capacity to be distributed among different kinds of ejectors in an appropriate manner.

BACKGROUND

In some vapour compression systems one or more ejectors is/are arranged in a refrigerant path, at a position downstream relative to a heat rejecting heat exchanger. Thereby refrigerant leaving the heat rejecting heat exchanger may be supplied to a primary inlet of the ejector(s).

An ejector is a type of pump which uses the Venturi effect to increase the pressure energy of fluid at a suction inlet (or secondary inlet) of the ejector by means of a motive fluid supplied to a motive inlet (or primary inlet) of the ejector. Thereby, arranging an ejector in the refrigerant path as described above will cause the refrigerant to perform work, and thereby the power consumption of the vapour compression system is reduced as compared to the situation where no ejector is provided.

The secondary inlet of the ejector(s) will normally be connected to a part of a return pipe of the vapour compression system. The return pipe interconnects an outlet of evaporator(s) of the vapour compression system and an inlet of a compressor unit of the vapour compression system. Accordingly, a suction line of the vapour compression system forms part of the return pipe and the return pipe receives refrigerant leaving the evaporator(s). Further components may form part of the return pipe, such as a liquid separator, a cyclotron or the like.

The refrigerant leaving the evaporator(s) and entering the return pipe may be in a gaseous form, in a liquid form or in the form of a mixture of gaseous and liquid refrigerant. While it is undesirable that liquid refrigerant reaches the compressor unit, it is possible to supply liquid refrigerant from the return pipe to the ejector(s), via the secondary inlet. Accordingly, liquid refrigerant can be removed from the return pipe in this manner before it reaches the compressor unit.

Various kinds of ejectors may be applied in vapour compression systems. One kind of ejector is sometimes referred to as a 'liquid ejector'. Such ejectors are often capable of operating efficiently when the pressure of refrigerant leaving the heat rejecting heat exchanger is low, and the pressure difference between the primary inlet of the ejector and the outlet of the ejector is therefore small. For instance, liquid ejectors are capable of providing a high pressure lift for the refrigerant supplied to the secondary inlet of the ejector under these circumstances. Accordingly, liquid ejectors may also be referred to as low pressure ejectors'.

Another kind of ejector is sometimes referred to as a 'gas ejector'. Such ejectors often require a somewhat larger pressure difference between the primary inlet of the ejector and the outlet of the ejector in order to provide a high pressure lift for the refrigerant supplied to the secondary inlet of the ejector. However, when such a high pressure difference is available, gas ejectors normally operate very energy efficiently. Accordingly, gas ejectors may also be referred to as 'high pressure ejectors'.

Thus, whether it is most desirable to apply a liquid ejector (or low pressure ejector) or a gas ejector (or high pressure ejector) may depend on the currently prevailing operating conditions.

SUMMARY

It is an object of embodiments of the invention to provide a method for controlling ejector capacity in a vapour compression system, in which it is ensured that the kind of ejector which is applied provides the most energy efficient operation of the vapour compression system.

It is a further object of embodiments of the invention to provide a method for controlling ejector capacity in a vapour compression system, in which it is ensured that the ejector(s) is/are capable of efficiently handling the flow of liquid refrigerant in the return pipe of the vapour compression system.

According to a first aspect the invention provides a method for controlling ejector capacity in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein each ejector is arranged in the refrigerant path with a primary inlet of the ejector connected to an outlet of the heat rejecting heat exchanger, an outlet of the ejector connected to the receiver and a secondary inlet of the ejector connected to a part of a return pipe receiving refrigerant from outlets of the evaporator(s), the method comprising the steps of:

- obtaining a parameter value being representative for a flow rate of liquid refrigerant from the evaporator(s) and into the return pipe, and
- adjusting the capacity of the ejector(s) based on the obtained parameter value.

The method according to the first aspect of the invention is a method for controlling ejector capacity in a vapour compression system. In the present context the term 'controlling ejector capacity' should be interpreted to cover controlling the total available ejector capacity to match system requirements, as well as controlling a distribution of the required ejector capacity among available ejectors and/or among various types of ejectors.

In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit comprising one or more compressors, a heat rejecting heat exchanger, at least one ejector, a receiver, at least one expansion device and at least one evaporator arranged in a refrigerant path. Thus, refrigerant flowing in the refrigerant path is compressed by the compressor(s) of the compressor unit before being supplied to the heat rejecting heat exchanger. In the heat rejecting heat exchanger, heat exchange takes place between the refrigerant and the ambient or a secondary fluid flow across the heat rejecting heat exchanger, in such a manner that heat is rejected from the refrigerant. The heat rejecting heat exchanger may be in the form of a condenser. In this case the refrigerant passing through the heat rejecting heat exchanger is at least partly condensed. As an alternative, the heat rejecting heat exchanger may be in the form of a gas cooler. In this case the temperature of the refrigerant passing through the heat rejecting heat exchanger is decreased, but it remains is a gaseous form.

The refrigerant leaving the heat rejecting heat exchanger is supplied to a primary inlet of the ejector(s), and from the outlet of the ejector(s) the refrigerant is supplied to the receiver. In the receiver the refrigerant is separated into a liquid part and a gaseous part. The liquid part of the refrigerant is supplied to the expansion device(s), where the refrigerant is expanded before being supplied to the evaporator(s). The refrigerant being supplied to the evaporator(s) is thereby in a mixed gaseous and liquid state. In the evaporator(s), the liquid part of the refrigerant is at least partly evaporated, while heat exchange takes place with the ambient or with a secondary fluid flow across the evaporator(s) in such a manner that heat is absorbed by the refrigerant flowing through the evaporator(s).

The refrigerant leaving the evaporator(s) is supplied to a return pipe which is also connected to an inlet of the compressor unit. From the return pipe refrigerant can be supplied to the compressor unit and/or to a secondary inlet of the ejector(s). For instance, any liquid refrigerant which is supplied to the return pipe from the evaporator(s) may advantageously be supplied to the secondary inlet of the ejector(s) in order to ensure that such liquid refrigerant does not reach the compressor unit.

Thus, refrigerant flowing in the refrigerant path is alternatingly compressed by the compressor(s) and expanded by the ejector(s) and the expansion device(s), while heat exchange takes place at the heat rejecting heat exchanger and the evaporator(s).

According to the method of the first aspect of the invention, a parameter value is initially obtained, which is representative for a flow rate of liquid refrigerant from the evaporator(s) and into the return pipe. Thus, the obtained parameter value provides information regarding how much liquid refrigerant is currently supplied to the return pipe, and which therefore needs to be supplied from the return pipe to the secondary inlet of the ejector(s) in order to protect the compressor(s) of the compressor unit.

Next, the capacity of the ejector(s) is adjusted, based on the obtained parameter value. Thus, the capacity of the ejector(s) is adjusted in accordance with the flow rate of liquid refrigerant from the evaporator(s) into the return pipe. Thereby it is ensured that the ejector capacity matches the inflow of liquid refrigerant into the return pipe, and that the ejector(s) is/are therefore capable of removing the liquid refrigerant from the return pipe.

It should be noted that the adjustment of the ejector capacity could include adjusting the total available ejector capacity as well as shifting the required ejector capacity between various ejectors and/or between various types of ejectors.

The step of adjusting the capacity of the ejectors may comprise manipulating at least one valve arranged to control a flow of refrigerant from the outlet of the heat rejecting heat exchanger towards the primary inlet of at least one ejector. Thereby a primary flow in the ejector(s) is adjusted. Adjusting the primary flow of an ejector affects the capability of the ejector to suck refrigerant into the secondary inlet of the ejector, and thereby the secondary flow of the ejector is also adjusted.

The manipulation of the valve may include opening or closing the valve. Alternatively or additionally it may include adjusting an opening degree of the valve, thereby increasing or decreasing the mass flow of refrigerant through the valve.

Alternatively or additionally, the step of adjusting the capacity of the ejectors may comprise manipulating at least one valve arranged to control a flow of refrigerant from the return pipe towards the secondary inlet of at least one ejector, thereby directly adjusting the secondary flow in the ejector.

The vapour compression system may comprise at least two ejectors, at least one of the ejectors being of a first, low pressure, kind and at least one of the ejectors being of a second, high pressure, kind.

According to this embodiment, the vapour compression system is provided with at least one low pressure ejector (or 'liquid ejector') and at least one high pressure ejector (or 'gas ejector'). As described above, it is desirable to apply low pressure ejectors under some operating conditions, while it is desirable to apply high pressure ejectors under other operating conditions. It is an advantage of this embodiment that both kinds of ejectors are available, because this allows the most suitable kind of ejector to be selected, depending on the currently prevailing operating conditions. Thus, according to this embodiment, the step of adjusting the capacity of the ejectors may include shifting or transferring capacity from one ejector kind to another.

Thus, the step of adjusting the capacity of the ejectors may comprise:

- increasing the capacity of at least one low pressure ejector and decreasing the capacity of at least one high pressure ejector, in the case that the obtained parameter value indicates a flow rate of liquid refrigerant which is above a predefined threshold value, and
- decreasing the capacity of at least one low pressure ejector and increasing the capacity of at least one high pressure ejector, in the case that the obtained parameter value indicates a flow rate of liquid refrigerant which is below the predefined threshold value.

In the case that the obtained parameter value reveals that the flow rate of liquid refrigerant from the evaporator(s) and into the return pipe is high, i.e. above the predefined threshold value, this is an indication that relatively large amounts of liquid refrigerant needs to be removed from the return pipe by the ejectors. Thus, under these circumstances it is most suitable to apply ejectors which most efficiently remove liquid refrigerant, such as low pressure ejectors. Therefore, when this occurs, the capacity of at least one low pressure ejector is increased, while the capacity of at least one high pressure ejector is decreased. Thereby ejector capacity is shifted or transferred from the high pressure ejectors to the low pressure ejectors, thereby allowing liquid refrigerant to be removed more efficiently from the return pipe.

Similarly, in the case that the obtained parameter value reveals that the flow rate of liquid refrigerant from the evaporator(s) and into the return pipe is low, i.e. below the predefined threshold value, this is an indication that the need for removing liquid refrigerant from the return pipe by the ejectors is not as urgent. Thus, under these circumstances the ejectors to be applied can be selected based on other criteria, such as their ability to operate efficiently, which is, e.g., the case for high pressure ejectors. Therefore, when this occurs, the capacity of at least one low pressure ejector is decreased, while the capacity of at least one high pressure ejector is increased. Thereby ejector capacity is shifted or transferred from the low pressure ejectors to the high pressure ejectors.

The obtained parameter may be a compressor capacity, a number of flooded evaporators, an estimated or measured value for the flow rate of liquid refrigerant in the return pipe, a superheat value, and/or a flow rate of refrigerant at the outlet of the heat rejecting heat exchanger.

In the present context the term 'flooded evaporator' should be interpreted to mean an evaporator in which liquid refrigerant is present through the entire length of the evaporator. Thus, when an evaporator is flooded, there is a high likelihood that liquid refrigerant will leave the evaporator and enter the return pipe. Therefore the number of flooded evaporators in the vapour compression system provides a measure for the expected flow rate of liquid refrigerant from the evaporator(s) and into the return pipe.

Increasing/decreasing the compressor capacity will result in an increase/decrease of mass flow of refrigerant from the evaporators towards the return pipe. It may be assumed that, given that the evaporators are allowed to operate in a flooded state, the percentage of the total mass flow of refrigerant being liquid refrigerant is approximately constant when the total mass flow changes. Therefore an increase/decrease in the total mass flow of refrigerant results in a corresponding increase/decrease in the flow rate of liquid refrigerant from the evaporators and into the return pipe. Accordingly, a measure for this flow rate can be derived from the compressor capacity.

The flow rate of refrigerant at the outlet of the heat rejecting heat exchanger depends on the compressor capacity. Accordingly, a measure for the flow rate of liquid refrigerant from the evaporators into the return pipe can be derived from the flow rate of refrigerant at the outlet of the heat rejecting heat exchanger for the reasons set forth above.

The superheat value is the difference between the evaporating temperature of an evaporator and the temperature of refrigerant leaving the evaporator. Thus, a high superheat value indicates that all of the refrigerant passing through the evaporator is evaporated, and that the expected flow rate of liquid refrigerant from that evaporator into the return pipe is very small. On the other hand, a low superheat value indicates that the evaporator is operated in a flooded state or close to a flooded state, the expected flow rate of liquid refrigerant from the evaporator into the return pipe thereby being somewhat higher. Accordingly, the superheat value provides a suitable measure for the flow rate of liquid refrigerant from the evaporators into the return pipe.

According to a second aspect the invention provides a method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein each ejector is arranged in the refrigerant path with a primary inlet of the ejector connected to an outlet of the heat rejecting heat exchanger, an outlet of the ejector connected to the receiver and a secondary inlet of the ejector connected to a part of a return pipe receiving refrigerant from outlets of the evaporator(s), and wherein at least one of the ejector(s) is of a first, low pressure, kind, the method comprising the steps of:

obtaining a pressure value of refrigerant leaving the heat rejecting heat exchanger, and/or a temperature value of refrigerant leaving the heat rejecting heat exchanger, and/or an ambient temperature value, and controlling at least the low pressure ejector(s) based on the obtained pressure value and/or temperature value.

It is noted that a person skilled in the art would readily recognise that any feature described in combination with the first aspect of the invention could also be combined with the first aspect of the invention, and vice versa.

The method according to the second aspect of the invention is a method for controlling at least one ejector in a vapour compression system. The vapour compression system is essentially of the kind described above with reference to the first aspect of the invention, and it will therefore not be described in detail here. However, according to the second aspect of the invention at least one of the ejectors is a low pressure ejector.

According to the method of the second aspect of the invention, a pressure value of refrigerant leaving the heat rejecting heat exchanger, and/or a temperature value of refrigerant leaving the heat rejecting heat exchanger, and/or an ambient temperature is initially obtained.

The temperature of refrigerant leaving the heat rejecting heat exchanger and the ambient temperature are both closely tied to the pressure of refrigerant leaving the heat rejecting heat exchanger. Therefore this initial step basically amounts to obtaining a parameter value which reflects the pressure of refrigerant leaving the heat rejecting heat exchanger.

Next, at least the low pressure ejector(s) is/are controlled based on the obtained value, i.e. in accordance with the pressure of refrigerant leaving the heat rejecting heat exchanger.

The pressure of refrigerant leaving the heat rejecting heat exchanger corresponds to the pressure at the primary inlet of the ejectors. This pressure has an impact on the pressure difference across the ejectors, i.e. the difference between the pressure at the primary inlet of the ejectors and the pressure at the outlet of the ejectors. As described above, when this pressure difference is high, high pressure ejectors operate very efficiently, while low pressure ejectors operate most efficiently when this pressure difference is low. Therefore, a parameter value reflecting the pressure of refrigerant leaving the heat rejecting heat exchanger provides an indication regarding whether or not a low pressure ejector would provide the most efficient manner of removing refrigerant from the return pipe. Accordingly, the low pressure ejectors can advantageously be controlled based on the obtained pressure and/or temperature value.

The step of controlling at least the low pressure ejector(s) may comprise preventing a flow of refrigerant from the outlet of the heat rejecting heat exchanger to the primary inlet of at least one low pressure ejector in the case that the pressure of refrigerant leaving the heat rejecting heat exchanger is above a predefined pressure threshold level and/or the temperature of refrigerant leaving the heat rejecting heat exchanger is above a predefined temperature threshold level.

As described above, when the pressure of refrigerant leaving the heat rejecting heat exchanger is high, i.e. above the pressure threshold level, the pressure difference across the ejectors may also be expected to be high. Accordingly, high pressure ejectors may be assumed to be able to remove refrigerant from the return pipe in a more efficient manner than low pressure ejectors. Therefore, when this situation occurs, flow of refrigerant from the heat rejecting heat exchanger towards the primary inlet of at least one low pressure ejector is prevented. Thereby there will be no primary flow through this ejector, and it will therefore not be able to suck refrigerant from the return pipe via the secondary inlet. Accordingly, the low pressure ejector capacity is reduced, thereby allowing the refrigerant to be removed from the return pipe in the most efficient manner under the given circumstances.

A high temperature of refrigerant leaving the heat rejecting heat exchanger corresponds to a high pressure of refrigerant leaving the heat rejecting heat exchanger, and the remarks set forth above are therefore also applicable in the case that the low pressure ejector(s) is/are controlled based on the temperature of refrigerant leaving the heat rejecting heat exchanger.

Similarly, the step of controlling at least the low pressure ejector(s) may comprise allowing a flow of refrigerant from the outlet of the heat rejecting heat exchanger to the primary inlet of at least one low pressure ejector in the case that the pressure of refrigerant leaving the heat rejecting heat exchanger is below a predefined pressure threshold level and/or the temperature of refrigerant leaving the heat rejecting heat exchanger is below a predefined temperature threshold level.

As described above, when the pressure of refrigerant leaving the heat rejecting heat exchanger is low, i.e. below the pressure threshold level, the pressure difference across the ejectors may also be expected to be low. Accordingly, low pressure ejectors may be assumed to be able to remove refrigerant from the return pipe in a more efficient manner than high pressure ejectors. Therefore, when this situation occurs, flow of refrigerant from the heat rejecting heat exchanger towards the primary inlet of at least one low pressure ejector is allowed. Thereby a primary flow through this ejector is established, and it will therefore be able to suck refrigerant from the return pipe via the secondary inlet. Accordingly, the low pressure ejector capacity is increased, thereby allowing the refrigerant to be removed from the return pipe in the most efficient manner under the given circumstances.

A low temperature of refrigerant leaving the heat rejecting heat exchanger corresponds to a low pressure of refrigerant leaving the heat rejecting heat exchanger, and the remarks set forth above are therefore also applicable in the case that the low pressure ejector(s) is/are controlled based on the temperature of refrigerant leaving the heat rejecting heat exchanger.

The method may further comprise the step of obtaining a refrigerant pressure at an outlet of the ejector(s), and the step of controlling at least the low pressure ejector(s) may further be based on a pressure difference and/or a pressure ratio between the refrigerant pressure at the primary inlet of the ejector(s) and the refrigerant pressure at the outlet of the ejector(s). According to this embodiment, the basis for controlling the low pressure ejector(s) is more accurate, since it includes the actual pressure difference across the ejectors, in the form of the pressure difference and/or in the form of the pressure ratio, and not only the pressure at the primary inlet of the ejectors.

In this case the step of controlling at least the low pressure ejector(s) may comprise:

preventing a flow of refrigerant from the outlet of the heat rejecting heat exchanger to the primary inlet of at least one low pressure ejector in the case that the pressure difference and/or pressure ratio is above a predefined threshold level, and allowing a flow of refrigerant from the outlet of the heat rejecting heat exchanger to the primary inlet of at least one low pressure ejector in the case that the pressure difference and/or pressure ratio is below the predefined threshold level.

As described above, when the pressure difference across the ejectors is high, high pressure ejectors are capable of removing refrigerant from the return pipe more efficiently than low pressure ejectors, and when the pressure difference across the ejectors is low, low pressure ejectors are capable of removing refrigerant from the return pipe more efficiently than high pressure ejectors. Therefore it is appropriate to prevent a flow of refrigerant from the heat rejecting heat exchanger to the primary inlet of at least one low pressure ejector when the pressure difference and/or pressure ratio is above a predefined threshold level, and to allow such a flow when the pressure difference and/or pressure ratio is below the threshold level.

It should be noted that the predefined threshold level is not necessarily a fixed threshold level, but could be variable, e.g. depending on operating conditions or system specifications.

Alternatively or additionally, the method may further comprise the step of obtaining a refrigerant pressure at the secondary inlet of the ejector(s) and a refrigerant pressure at an outlet of the ejector(s), and the step of controlling at least the low pressure ejector(s) may further be based on a pressure difference and/or a pressure ratio between the refrigerant pressure at the secondary inlet of the ejector(s) and the refrigerant pressure at the outlet of the ejector(s). According to this embodiment, the basis for controlling the low pressure ejector(s) includes the pressure difference between the secondary inlet and the outlet of the ejector(s), i.e. the required pressure lift of the secondary flow through the ejectors to be performed by the primary flow.

The method may further comprise the step of calculating a pressure ratio:

$$\frac{P_{primary} - P_{outlet}}{P_{secondary} - P_{outlet}},$$

where $P_{primary}$ is a pressure prevailing at the primary inlet of the ejector(s), $P_{outlet}$ is a pressure prevailing at the outlet of the ejector(s) and $P_{secondary}$ is a pressure prevailing at the secondary inlet of the ejector(s), and the step of controlling at least the low pressure ejector(s) may further be performed on the basis of the calculated pressure ratio.

$P_{primary}$-$P_{outlet}$ is the pressure difference across the ejectors, as described above, i.e. the difference between the pressure prevailing at the primary inlet of the ejectors and the pressure prevailing at the outlet of the ejectors. Similarly, $P_{secondary}$-$P_{outlet}$ is the difference between the pressure prevailing at the secondary inlet of the ejectors and the pressure prevailing at the outlet of the ejectors.

$P_{primary}$-$P_{outlet}$ thus defines the capability of the ejectors to suck refrigerant from the return pipe via the secondary inlet. $P_{secondary}$-$P_{outlet}$ defines the required pressure lift of the secondary flow through the ejectors to be performed by the primary flow.

When the calculated pressure ratio is high, the available pressure difference of the primary flow is significantly larger than the pressure difference of the secondary flow. In this situation high pressure ejectors may be assumed to operate more efficiently than low pressure ejectors, and it may therefore be desirable to shift or transfer ejector capacity from low pressure ejectors towards high pressure ejectors.

Similarly, when the calculated pressure ratio is low, the available pressure difference of the primary flow is close to the pressure difference of the secondary flow. In this situation low pressure ejectors may be assumed to operate more efficiently than high pressure ejectors, and it may therefore be desirable to shift or transfer ejector capacity from high pressure ejectors towards low pressure ejectors.

Thus, the step of controlling at least the low pressure ejector(s) may comprise increasing a capacity of the low pressure ejector(s) in the case that the calculated pressure ratio is below a predefined threshold level.

BRIEF DESCRIPTION OF THE DRAWINGS

The invention will now be described in further detail with reference to the accompanying drawings in which.

DETAILED DESCRIPTION

Figure 1:
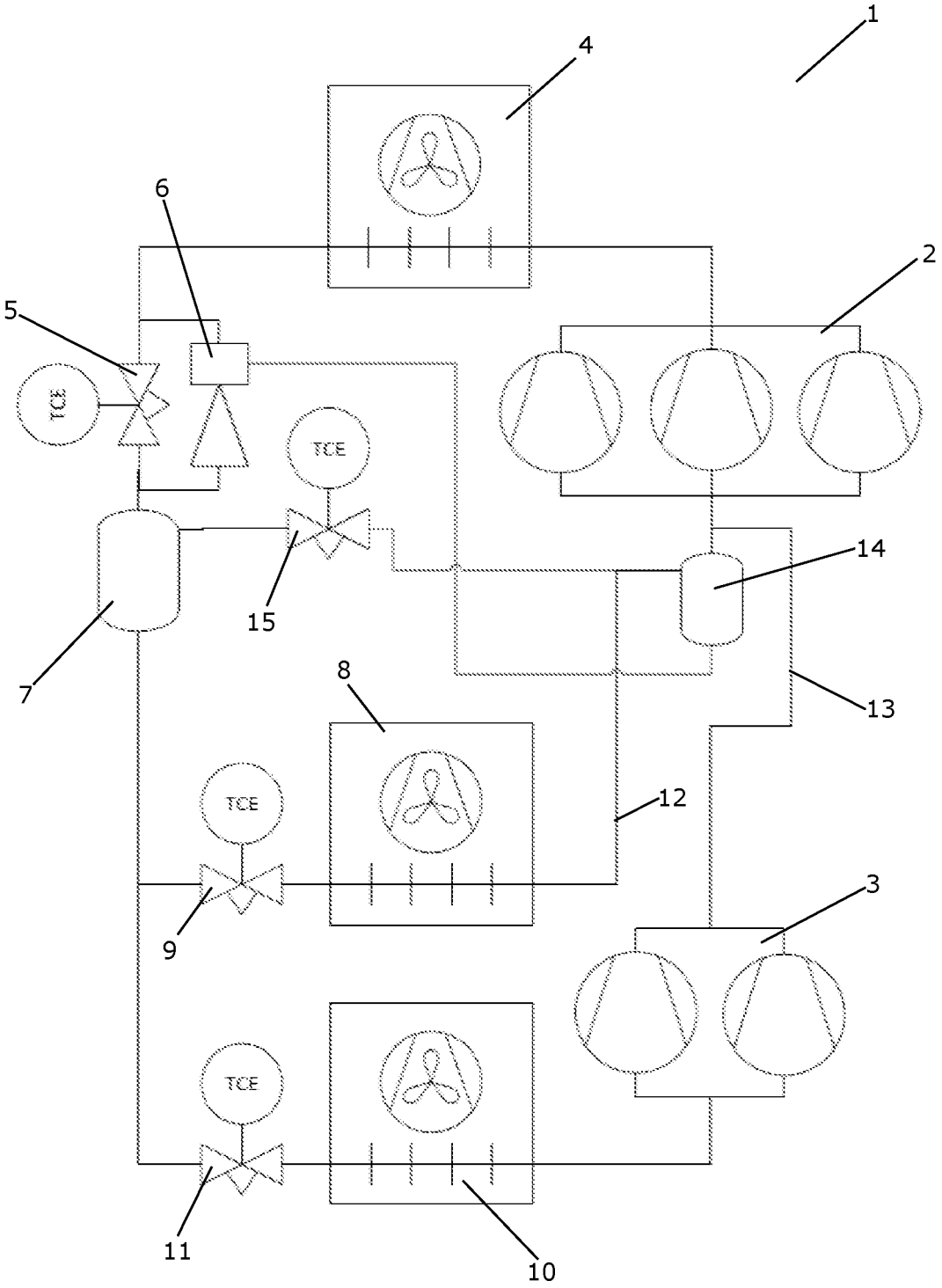
FIGS. 1-5 are diagrammatic views of vapour compression systems for performing methods according to various embodiments of the invention.

FIG. 1 is a diagrammatic view of a vapour compression system 1 for performing a method according to a first embodiment of the invention. The vapour compression system 1 comprises an MT compressor unit 2 and an LT compressor unit 3, each comprising a number of compressors. The vapour compression system 1 further comprises a heat rejecting heat exchanger 4, a high pressure valve 5, and ejector 6 and a receiver 7. A liquid outlet of the receiver 7 is connected to an MT evaporator 8 via an MT expansion valve 9 and to an LT evaporator 10 via an LT expansion valve 11. The evaporators 8, 10 are connected to an inlet of the MT compressor unit 2 via respective return pipes 12, 13.

The vapour compression system 1 of FIG. 1 may be operated in the following manner. Refrigerant is compressed by the compressors of the MT compressor unit 2 and supplied to the heat rejecting heat exchanger 4. In the heat rejecting heat exchanger 4, heat exchange takes place between the refrigerant flowing through the heat rejecting heat exchanger 4 and the ambient or a secondary fluid flow across the heat rejecting heat exchanger 4, in such a manner that heat is rejected from the refrigerant.

The refrigerant leaving the heat rejecting heat exchanger 4 passes through high pressure valve 5 or through the ejector 6, via a primary inlet of the ejector 6, before being supplied to the receiver 7. The refrigerant passing through the high pressure valve 5 or the ejector 6, respectively, undergoes expansion, and the refrigerant being supplied to the receiver 7 is therefore in a mixed gaseous and liquid state.

In the receiver 7, the refrigerant is separated into a liquid part and a gaseous part. The gaseous part of the refrigerant may be supplied to a liquid separator 14 forming part of return pipe 12, via a gas bypass valve 15. The liquid part of the refrigerant is supplied to the evaporators 9, 10, via the expansion valves 9, 11.

In the evaporators 8, 10, heat exchange takes place between the refrigerant flowing through the respective evaporator 8, 10 and the ambient or a secondary fluid flow across the evaporator 8, 10, in such a manner that heat is absorbed by the refrigerant, thereby providing cooling. The MT evaporator 8 is arranged to provide cooling within a first temperature range, and the LT evaporator 10 is arranged to provide cooling within a second temperature range, the second temperature range being lower than the first temperature range. For instance, the MT evaporator 8 may be applied for providing cooling to chilled display cases in which a temperature of approximately 5° C. is required, while the LT evaporator 10 may be applied for providing cooling to freezer display cases in which a temperature of approximately −18° C. is required. The refrigerant leaving the LT evaporator 10 will normally be at a lower pressure level than the refrigerant leaving the MT evaporator 8. It is noted that, even though only one MT evaporator 8 and one LT evaporator 10 are shown in FIG. 1, it is not ruled out that the vapour compression system 1 could comprise two or more MT evaporators 8 and/or two or more LT evaporators 10, e.g. arranged fluidly in parallel.

The refrigerant leaving the LT evaporator 10 is supplied to the LT compressor unit 3, where the refrigerant is compressed, thereby increasing the pressure, before the refrigerant is supplied to the MT compressor unit 2.

The refrigerant leaving the MT evaporator 10 is supplied to the liquid separator 14. In the case that the refrigerant leaving the MT evaporator 10 contains a liquid part, the liquid part of the refrigerant is separated from the gaseous part of the refrigerant in the liquid separator 14. Thereby it is prevented that liquid refrigerant reaches the MT compressor unit 2.

At least part of the gaseous part of the refrigerant in the liquid separator 14 is supplied to the MT compressor unit 2. The liquid part of the refrigerant in the liquid separator 14, and possibly part of the gaseous part of the refrigerant, is supplied to the secondary inlet of the ejector 6.

The ejector 6 may be operated in the following manner. A parameter being representative for a flow rate of liquid refrigerant from the MT evaporator 8 and into the return pipe 12 is obtained. The parameter could, e.g., be in the form of a compressor capacity of the MT compressor unit 2, a number of flooded MT evaporators 8, an estimated or measured value for the flow rate of liquid refrigerant in the return pipe 12 and/or a flow rate of refrigerant at the outlet of the heat rejecting heat exchanger 4. This has been described in detail above.

Since the obtained parameter is representative for a flow rate of liquid refrigerant from the MT evaporator 8 and into the return pipe 12, the parameter reflects the current need for removing liquid refrigerant from the return pipe 12, in order to prevent liquid refrigerant from reaching the MT compressor unit 2.

Thus, in the case that the obtained parameter indicates that the current capacity of the ejector 6 is insufficient to meet the current requirements with respect to removal of liquid refrigerant from the return pipe 12, the capacity of the ejector 6 is increased. Similarly, in the case that the obtained parameter indicates that the current capacity of the ejector 6 is higher than required, the capacity of the ejector 6 may be reduced.

As an alternative, the ejector 6 may be operated in the following manner. The pressure of refrigerant leaving the heat rejecting heat exchanger 4 may be obtained, e.g. by direct measurement. Alternatively, the temperature of refrigerant leaving the heat rejecting heat exchanger 4 or an ambient temperature may be measured. Based thereon, the ejector 6 may be controlled. For instance, the capacity of the ejector 6 may be decreased in the case that the pressure of refrigerant leaving the heat rejecting heat exchanger 4 is above a predefined threshold value, and the capacity of the ejector 6 may be increased in the case that the pressure of refrigerant leaving the heat rejecting heat exchanger 4 is below the predefined threshold value.

The capacity of the ejector 6 may, e.g., be adjusted by adjusting the supply of refrigerant from the outlet of the heat rejecting heat exchanger 4 to the primary inlet of the ejector 6. For instance, a valve controlling this refrigerant flow may be opened or closed, or an opening degree of such a valve may be adjusted. Alternatively or additionally, an opening degree of the high pressure valve 5 may be adjusted in order to increase or decrease the fraction of refrigerant flowing via the high pressure valve 5, thereby decreasing or increasing the fraction of refrigerant flowing via the ejector 6 correspondingly.

Figure 2:
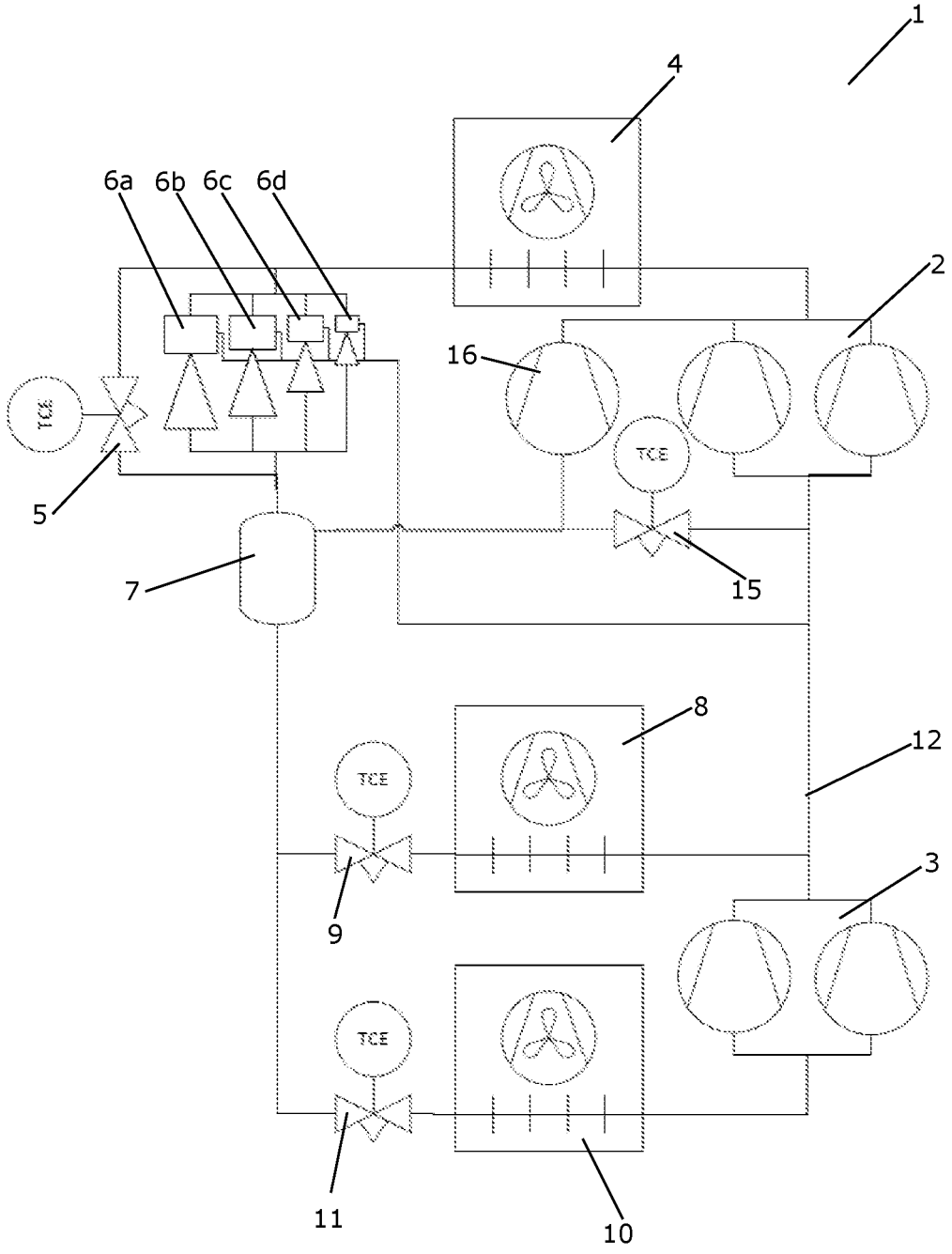

FIG. 2 is a diagrammatic view of a vapour compression system 1 for performing a method according to a second embodiment of the invention. The vapour compression system 1 of FIG. 2 is very similar to the vapour compression system 1 of FIG. 1, and it will therefore not be described in detail here.

In the vapour compression system 1 of FIG. 2, the refrigerant leaving the MT evaporator 8 as well as the refrigerant leaving the LT compressor unit 3 is supplied to a common return pipe 12. No liquid separator is arranged in the return pipe 12.

A receiver compressor 16 is connected directly to the gaseous outlet of the receiver 7. Thereby gaseous refrigerant can be supplied directly from the receiver 7 to the receiver compressor 16, thereby avoiding the pressure drop introduced in the expansion valves 9, 11 or in the gas bypass valve 15.

The vapour compression system 1 comprises four ejectors 6*a*, 6*b*, 6*c*, 6*d* arranged in parallel between the outlet of the heat rejecting heat exchanger 4 and the receiver 7. The ejectors 6*a*, 6*b*, 6*c*, 6*d* each has a capacity which varies from the capacity of each of the other ejectors 6*a*, 6*b*, 6*c*, 6*d*. Thus, ejector 6*a* has the highest capacity and ejector 6*d* has the lowest capacity. Ejector 6*b* has a capacity which is lower than the capacity of ejector 6*a*, but higher than the capacity of ejectors 6*c* and 6*d*, and ejector 6*c* has a capacity which is lower than the capacity of ejectors 6*a* and 6*b*, but higher than the capacity of ejector 6*d*.

Accordingly, by appropriately selecting which of the ejectors 6*a*, 6*b*, 6*c*, 6*d* should be switched on, i.e. receive refrigerant via its primary inlet, and which of the ejectors 6*a*, 6*b*, 6*c*, 6*d* should be switched off, i.e. not receive refrigerant via its primary inlet, the total capacity of the ejectors 6*a*, 6*b*, 6*c*, 6*d* can be adjusted.

Figure 3:
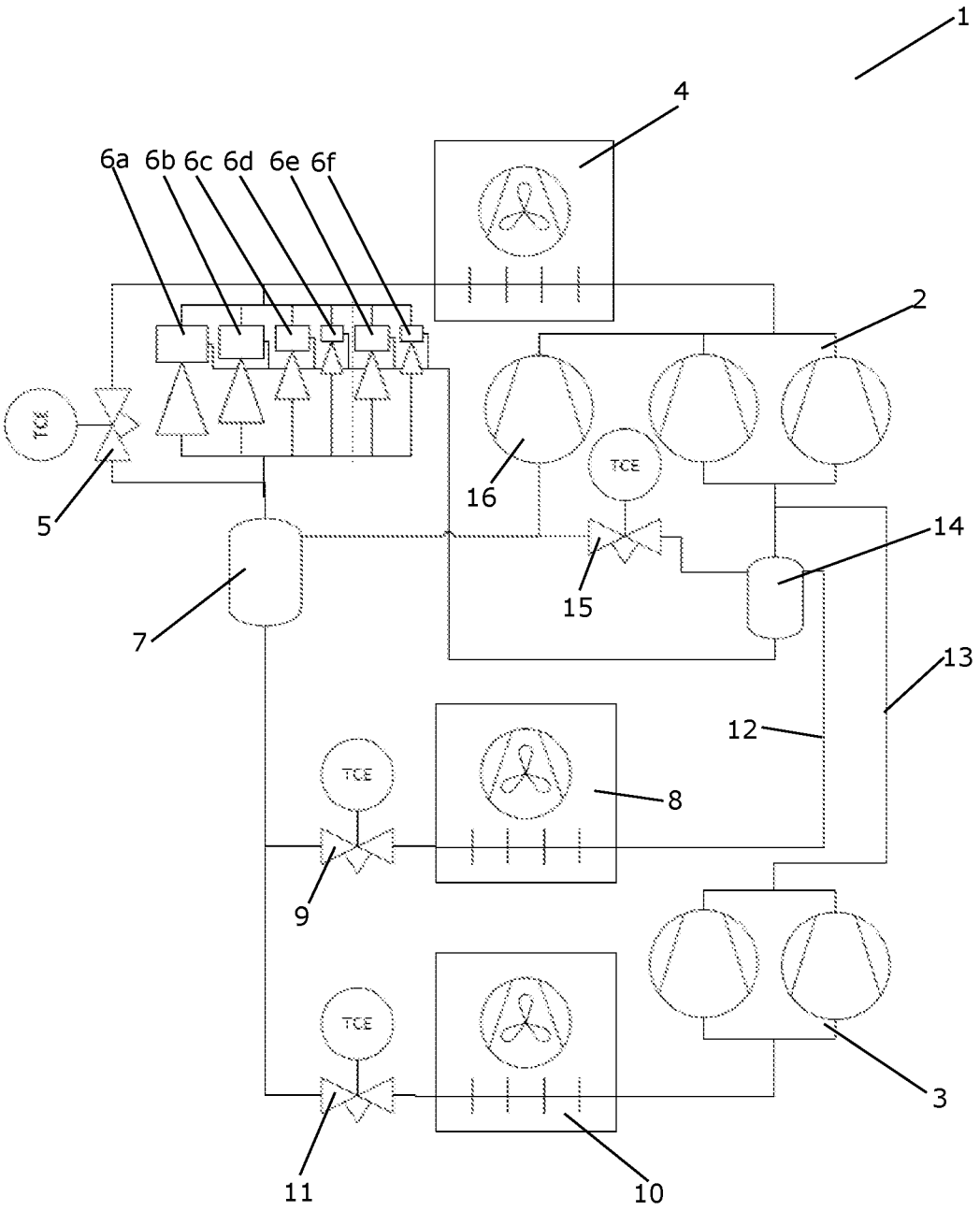

FIG. 3 is a diagrammatic view of a vapour compression system 1 for performing a method according to a third embodiment of the invention. The vapour compression system 1 of FIG. 3 is very similar to the vapour compression systems 1 of FIGS. 1 and 2, and it will therefore not be described in detail here.

The vapour compression system 1 of FIG. 3 comprises six ejectors 6*a*, 6*b*, 6*c*, 6*d*, 6*e*, 6*f* arranged in parallel between the outlet of the heat rejecting heat exchanger 4 and the receiver 7. The ejectors 6*a*, 6*b*, 6*c*, 6*d*, 6*e*, 6*f* have various capacities, similarly to the situation described above with reference to FIG. 2.

Four of the ejectors 6*a*, 6*b*, 6*c*, 6*d* are in the form of low pressure ejectors (or liquid ejectors) and two of the ejectors 6*e*, 6*f* are in the form of high pressure ejectors (or gas ejectors). As described above, low pressure ejectors 6*a*, 6*b*, 6*c*, 6*d* normally operate efficiently when the pressure of refrigerant leaving the heat rejecting heat exchanger 4 is low, and when the pressure difference between the primary inlet of the ejector 6*a*, 6*b*, 6*c*, 6*d* and the outlet of the ejector 6*a*, 6*b*, 6*c*, 6*d* is therefore small. For instance, low pressure ejectors 6*a*, 6*b*, 6*c*, 6*d* are capable of providing a high pressure lift for the refrigerant supplied to the secondary inlet of the ejector 6*a*, 6*b*, 6*c*, 6*d* under these circumstances.

On the other hand, high pressure ejectors 6*e*, 6*f* often require a somewhat larger pressure difference between the primary inlet of the ejector 6*e*, 6*f* and the outlet of the ejector 6*e*, 6*f* in order to provide a high pressure lift for the refrigerant supplied to the secondary inlet of the ejector 6*e*, 6*f*. However, under these circumstances, high pressure ejectors 6*e*, 6*f* normally operate more efficiently than low pressure ejectors 6*a*, 6*b*, 6*c*, 6*d*.

When controlling the ejectors 6*a*, 6*b*, 6*c*, 6*d*, 6*e*, 6*f*, e.g. essentially as described above with reference to FIGS. 1 and 2, the control may include shifting ejector capacity between the low pressure ejectors 6*a*, 6*b*, 6*c*, 6*d* and the high pressure ejectors 6*e*, 6*f*. For instance, in the case that the obtained parameter being representative for a flow rate of liquid refrigerant from the MT evaporator 8 and into the return pipe 12 reveals that it is required that a relatively large amount of liquid refrigerant needs to be removed from the return pipe 12, then the capacity of the ejectors 6*a*, 6*b*, 6*c*, 6*d*, 6*e*, 6*f* may be adjusted in such a manner that the total capacity of the low pressure ejectors 6*a*, 6*b*, 6*c*, 6*d* is increased while the total capacity of the high pressure ejectors 6*e*, 6*f* is decreased. Thereby it is ensured that the ejectors 6*a*, 6*b*, 6*c*, 6*d*, 6*e*, 6*f* which are actually operating are capable of handling the liquid refrigerant flow towards the return pipe 12.

Similarly, in the case that it is revealed that the current operating conditions are such that the high pressure ejectors 6*e*, 6*f* are expected to operate more efficiently than the low pressure ejectors 6*a*, 6*b*, 6*c*, 6*d*, then the capacity of the ejectors 6*a*, 6*b*, 6*c*, 6*d*, 6*e*, 6*f* may be adjusted in such a manner that the total capacity of the low pressure ejectors 6*a*, 6*b*, 6*c*, 6*d* is decreased while the total capacity of the high pressure ejectors 6*e*, 6*f* is increased. Thereby it is ensured that the vapour compression system 1 is operated as efficiently as possible.

Figure 4:
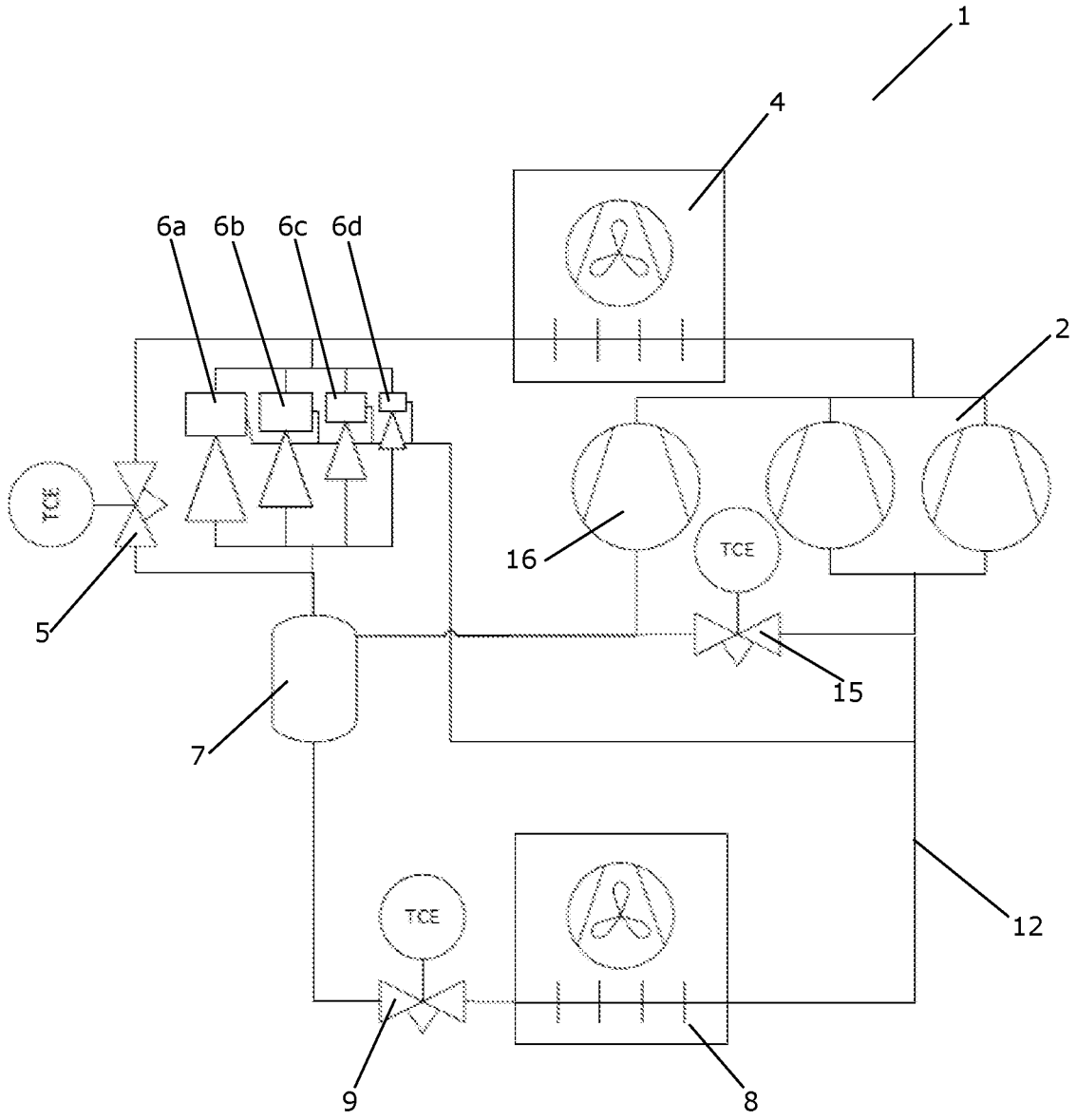

FIG. 4 is a diagrammatic view of a vapour compression system 1 for performing a method according to a fourth embodiment of the invention. The vapour compression system 1 of FIG. 4 is very similar to the vapour compression system 1 of FIG. 2, and it will therefore not be described in detail here.

The vapour compression system 1 of FIG. 4 only comprises an MT compressor unit 2 and an MT evaporator 8, i.e. the LT compressor unit and the LT evaporator of the vapour compression system 1 of FIG. 2 are not present in the vapour compression system 1 of FIG. 4. The ejectors 6*a*, 6*b*, 6*c*, 6*d* of the vapour compression system 1 of FIG. 4 are controlled essentially as described above with reference to FIG. 2.

Figure 5:
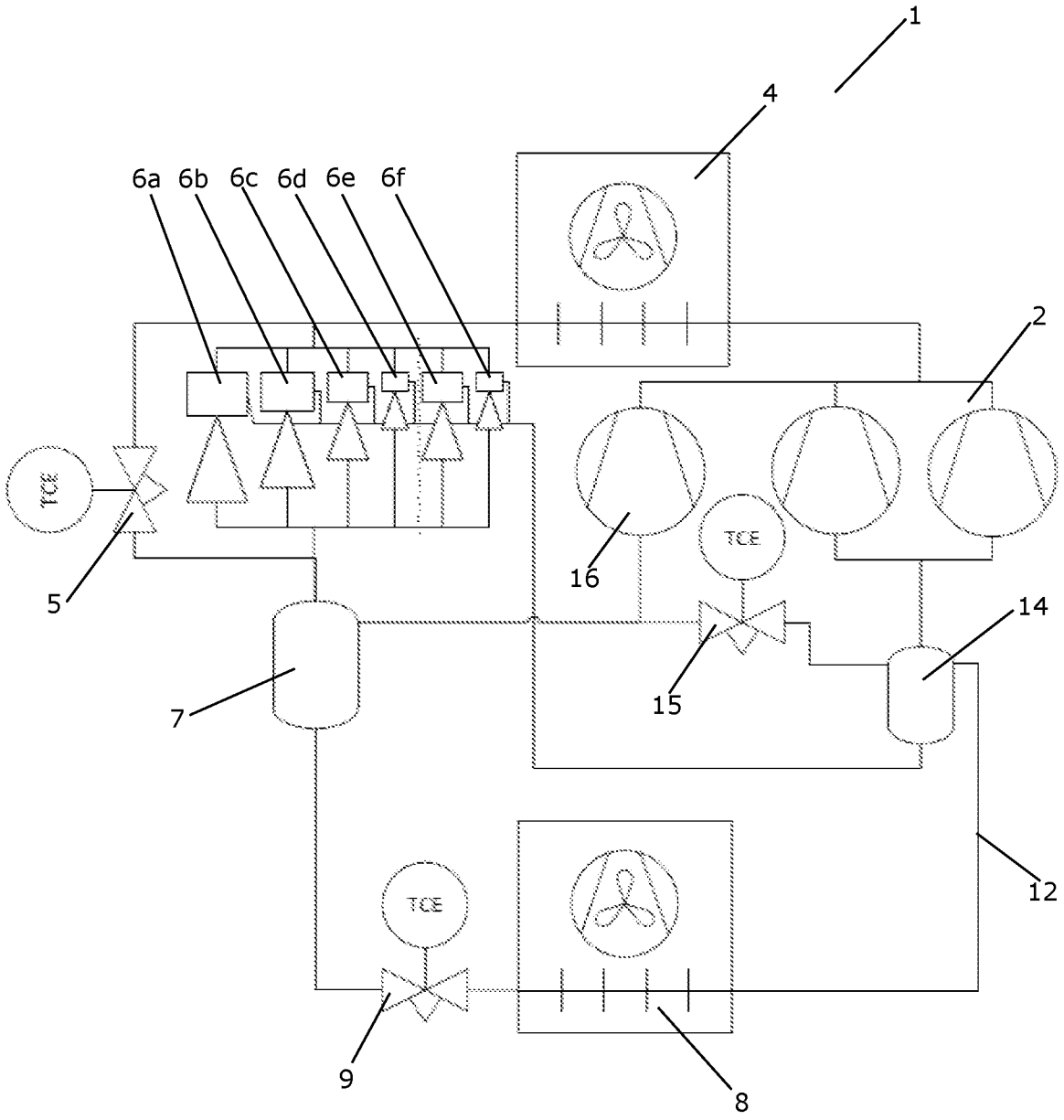

FIG. 5 is a diagrammatic view of a vapour compression system 1 for performing a method according to a fifth embodiment of the invention. The vapour compression system 1 of FIG. 5 is very similar to the vapour compression system 1 of FIG. 3, and it will therefore not be described in detail here.

The vapour compression system 1 of FIG. 5 only comprises an MT compressor unit 2 and an MT evaporator 8, i.e. the LT compressor unit and the LT evaporator of the vapour compression system 1 of FIG. 3 are not present in the vapour compression system 1 of FIG. 5. The ejectors 6*a*, 6*b*, 6*c*, 6*d*, 6*e*, 6*f* of the vapour compression system 1 of FIG. 5 are controlled essentially as described above with reference to FIG. 3.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein the at least one ejector is arranged in the refrigerant path with a primary inlet of the at least one ejector connected to an outlet of the heat rejecting heat exchanger, an outlet of the at least one ejector connected to the receiver and a secondary inlet of the at least one ejector connected to a part of a return pipe receiving refrigerant from outlets of the at least one evaporator, the method comprising the steps of:

obtaining a pressure value of refrigerant leaving the heat rejecting heat exchanger, and/or a temperature value of refrigerant leaving the heat rejecting heat exchanger, and/or an ambient temperature value, controlling at least the pressure of the at least one ejector based on the obtained pressure value and/or temperature value, and calculating a pressure ratio:

$$P_{primary}-P_{outlet}/P_{secondary}/P_{outlet}$$

where $P_{primary}$ is a pressure prevailing at the primary inlet of the at least one ejector, $P_{outlet}$ is a pressure prevailing at the outlet of the at least one ejector and $P_{Secondary}$ is a pressure prevailing at the secondary inlet of the at least one ejector, and wherein the step of controlling at least the pressure of the at least one ejector is further performed on the basis of the calculated pressure ratio.

2. A method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein the at least one ejector is arranged in the refrigerant path with a primary inlet of the at least one ejector connected to an outlet of the heat rejecting heat exchanger, an outlet of the at least one ejector connected to the receiver and a secondary inlet of the at least one ejector connected to a part of a return pipe receiving refrigerant from outlets of the at least one evaporator, the method comprising the steps of:

obtaining a pressure value of refrigerant leaving the heat rejecting heat exchanger, and/or a temperature value of refrigerant leaving the heat rejecting heat exchanger, and/or an ambient temperature value, and controlling at least the pressure of the at least one ejector based on the obtained pressure value and/or temperature value, wherein the step of controlling at least the pressure of the at least one ejector comprises preventing a flow of refrigerant from the outlet of the heat rejecting heat exchanger to the primary inlet of the at least one ejector in the case that the pressure of refrigerant leaving the heat rejecting heat exchanger is above a predefined pressure threshold level and/or the temperature of refrigerant leaving the heat rejecting heat exchanger is above a predefined temperature threshold level, and wherein the step of controlling at least the pressure of the at least one ejector comprises increasing a capacity of the pressure of the at least one ejector in the case that the calculated pressure ratio is below a predefined threshold level.

3. A method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein the at least one ejector is arranged in the refrigerant path with a primary inlet of the at least one ejector connected to an outlet of the heat rejecting heat exchanger, an outlet of the at least one ejector connected to the receiver and a secondary inlet of the at least one ejector connected to a part of a return pipe receiving refrigerant from outlets of the at least one evaporator, the method comprising the steps of:

obtaining a pressure value of refrigerant leaving the heat rejecting heat exchanger, and/or a temperature value of refrigerant leaving the heat rejecting heat exchanger, and/or an ambient temperature value, and controlling at least the pressure of the at least one ejector based on the obtained pressure value and/or temperature value, wherein the step of controlling at least the pressure of the at least one ejector comprises preventing a flow of refrigerant from the outlet of the heat rejecting heat exchanger to the primary inlet of the at least one ejector in the case that the pressure of refrigerant leaving the heat rejecting heat exchanger is above a predefined pressure threshold level and/or the temperature of refrigerant leaving the heat rejecting heat exchanger is above a predefined temperature threshold level, and wherein the step of controlling at least the pressure of the at least one ejector comprises allowing a flow of refrigerant from the outlet of the heat rejecting heat exchanger to the primary inlet of the at least one ejector in the case that the pressure of refrigerant leaving the heat rejecting heat exchanger is below a predefined pressure threshold level and/or the temperature of refrigerant leaving the heat rejecting heat exchanger is below a predefined temperature threshold level.

4. A method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein the at least one ejector is arranged in the refrigerant path with a primary inlet of the at least one ejector connected to an outlet of the heat rejecting heat exchanger, an outlet of the at least one ejector connected to the receiver and a secondary inlet of the at least one ejector connected to a part of a return pipe receiving refrigerant from outlets of the at least one evaporator, the method comprising the steps of:

obtaining a pressure value of refrigerant leaving the heat rejecting heat exchanger, and/or a temperature value of refrigerant leaving the heat rejecting heat exchanger, and/or an ambient temperature value, and controlling at least the pressure of the at least one ejector based on the obtained pressure value and/or temperature value, wherein the step of controlling at least the pressure of the at least one ejector comprises preventing a flow of refrigerant from the outlet of the heat rejecting heat exchanger to the primary inlet of the at least one ejector in the case that the pressure of refrigerant leaving the heat rejecting heat exchanger is above a predefined pressure threshold level and/or the temperature of refrigerant leaving the heat rejecting heat exchanger is above a predefined temperature threshold level, and further comprising the step of obtaining a refrigerant pressure at an outlet of the at least one ejector and wherein the step of controlling at least the pressure of the at least one ejector is further based on a pressure difference and/or a pressure ratio between the refrigerant pressure at the primary inlet of the at least one ejector and the refrigerant pressure at the outlet of the at least one ejector.

5. A method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein the at least one ejector is arranged in the refrigerant path with a primary inlet of the at least one ejector connected to an outlet of the heat rejecting heat exchanger, an outlet of the at least one ejector connected to the receiver and a secondary inlet of the at least one ejector connected to a part of a return pipe receiving refrigerant from outlets of the at least one evaporator, the method comprising the steps of:

obtaining a pressure value of refrigerant leaving the heat rejecting heat exchanger, and/or a temperature value of refrigerant leaving the heat rejecting heat exchanger, and/or an ambient temperature value, controlling at least the pressure of the at least one ejector based on the obtained pressure value and/or temperature value, wherein the step of controlling at least the pressure of the at least one ejector comprises allowing a flow of refrigerant from the outlet of the heat rejecting heat exchanger to the primary inlet of the at least one ejector in the case that the pressure of refrigerant leaving the heat rejecting heat exchanger is below a predefined pressure threshold level and/or the temperature of refrigerant leaving the heat rejecting heat exchanger is below a predefined temperature threshold level, and further comprising the step of obtaining a refrigerant pressure at an outlet of the at least one ejector, and wherein the step of controlling at least the pressure of the at least one ejector is further based on a pressure difference and/or a pressure ratio between the refrigerant pressure at the primary inlet of the at least one ejector and the refrigerant pressure at the outlet of the at least one ejector.

6. A method for controlling at least one ejector in a vapour compression system, the vapour compression system comprising a compressor unit comprising one or more compressors, a heat rejecting heat exchanger, at least one ejector, a receiver, at least one expansion device and at least one evaporator arranged in a refrigerant path, wherein the at least one ejector is arranged in the refrigerant path with a primary inlet of the at least one ejector connected to an outlet of the heat rejecting heat exchanger, an outlet of the at least one ejector connected to the receiver and a secondary inlet of the at least one ejector connected to a part of a return pipe receiving refrigerant from outlets of the at least one evaporator, the method comprising the steps of:

obtaining a pressure value of refrigerant leaving the heat rejecting heat exchanger, and/or a temperature value of refrigerant leaving the heat rejecting heat exchanger, and/or an ambient temperature value, controlling at least the pressure of the at least one ejector based on the obtained pressure value and/or temperature value, and obtaining a refrigerant pressure at the secondary inlet of the at least one ejector and a refrigerant pressure at an outlet of the at least one ejector, wherein the step of controlling at least the pressure of the at least one ejector is further based on a pressure difference and/or a pressure ratio between the refrigerant pressure at the secondary inlet of the at least one ejector and the refrigerant pressure at the outlet of the at least one ejector.

7. The method according to claim 6, further comprising the step of calculating a pressure ratio:

$$\frac{P_{primary} - P_{outlet}}{P_{secondary} - P_{outlet}},$$

where $P_{primary}$ is a pressure prevailing at the primary inlet of the at least one ejector, $P_{outlet}$ is a pressure prevailing at the outlet of the at least one ejector and $P_{Secondary}$ is a pressure prevailing at the secondary inlet of the at least one ejector, and wherein the step of controlling at least the pressure of the at least one ejector is further performed on the basis of the calculated pressure ratio.

8. The method according to claim 6, wherein the step of controlling at least the pressure of the at least one ejector comprises allowing a flow of refrigerant from the outlet of the heat rejecting heat exchanger to the primary inlet of the at least one ejector in the case that the pressure of refrigerant leaving the heat rejecting heat exchanger is below a predefined pressure threshold level and/or the temperature of refrigerant leaving the heat rejecting heat exchanger is below a predefined temperature threshold level.

9. The method according claim 8, further comprising the step of obtaining a refrigerant pressure at an outlet of the at least one ejector, and wherein the step of controlling at least the pressure of the at least one ejector is further based on a pressure difference and/or a pressure ratio between the refrigerant pressure at the primary inlet of the at least one ejector and the refrigerant pressure at the outlet of the at least one ejector.

10. The method according to claim 6, further comprising the step of obtaining a refrigerant pressure at an outlet of the at least one ejector, and wherein the step of controlling at least the pressure of the at least one ejector is further based on a pressure difference and/or a pressure ratio between the refrigerant pressure at the primary inlet of the at least one ejector and the refrigerant pressure at the outlet of the at least one ejector.

11. The method according to claim 10, wherein the step of controlling at least the pressure of the at least one ejector comprises:

preventing a flow of refrigerant from the outlet of the heat rejecting heat exchanger to the primary inlet of the at least one ejector in the case that the pressure difference and/or pressure ratio is above a predefined threshold level, and allowing a flow of refrigerant from the outlet of the heat rejecting heat exchanger to the primary inlet of the at least one ejector in the case that the pressure difference and/or pressure ratio is below the predefined threshold level.

12. The method according to claim 6, wherein the step of controlling at least the pressure of the at least one ejector comprises preventing a flow of refrigerant from the outlet of the heat rejecting heat exchanger to the primary inlet of the at least one ejector in the case that the pressure of refrigerant leaving the heat rejecting heat exchanger is above a predefined pressure threshold level and/or the temperature of the refrigerant leaving the heat rejecting heat exchanger is above a predefined temperature threshold level.

13. The method according to claim 12, wherein the step of controlling at least the pressure of the at least one ejector comprises increasing a capacity of the pressure of the at least one ejector in the case that the calculated pressure ratio is below a predefined threshold level.

14. The method according to claim 12, wherein the step of controlling at least the pressure of the at least one ejector comprises allowing a flow of refrigerant from the outlet of the heat rejecting heat exchanger to the primary inlet of the at least one ejector in the case that the pressure of refrigerant leaving the heat rejecting heat exchanger is below a predefined pressure threshold level and/or the temperature of refrigerant leaving the heat rejecting heat exchanger is below a predefined temperature threshold level.

15. The method according claim 12, further comprising the step of obtaining a refrigerant pressure at an outlet of the at least one ejector, and wherein the step of controlling at least the pressure of the at least one ejector is further based on a pressure difference and/or a pressure ratio between the refrigerant pressure at the primary inlet of the at least one ejector and the refrigerant pressure at the outlet of the at least one ejector.

* * * * *